US008287330B1

(12) United States Patent
Bennett et al.

(10) Patent No.: US 8,287,330 B1
(45) Date of Patent: Oct. 16, 2012

(54) REDUCING POLISHING PAD DEFORMATION

(75) Inventors: Doyle E. Bennett, Santa Clara, CA (US); Boguslaw A. Swedek, Cupertino, CA (US); David J. Lischka, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 79 days.

(21) Appl. No.: 12/625,412

(22) Filed: Nov. 24, 2009

Related U.S. Application Data

(63) Continuation of application No. 11/683,392, filed on Mar. 7, 2007, now Pat. No. 7,621,798.

(60) Provisional application No. 60/780,151, filed on Mar. 7, 2006.

(51) Int. Cl.
*B24B 49/12* (2006.01)

(52) U.S. Cl. ..... 451/6; 451/527

(58) Field of Classification Search ..... 451/526, 451/527, 530, 533, 534, 285, 288, 41, 6
See application file for complete search history.

(56) References Cited

U.S. PATENT DOCUMENTS

| | | | | |
|---|---|---|---|---|
| 6,248,000 | B1 | 6/2001 | Aiyer | |
| 6,254,459 | B1 | 7/2001 | Bajaj et al. | |
| 7,118,457 | B2 * | 10/2006 | Swedek et al. | 451/41 |
| 2003/0148721 | A1 | 8/2003 | Birang et al. | |
| 2003/0236055 | A1 | 12/2003 | Swedek et al. | |
| 2005/0136800 | A1 | 6/2005 | Miller et al. | |

* cited by examiner

*Primary Examiner* — Robert Rose
(74) *Attorney, Agent, or Firm* — Fish & Richardson P.C.

(57) ABSTRACT

A chemical mechanical polishing pad is described. A chemical mechanical polishing pad has an outer layer that includes a polishing surface, a first thinned region defined by a recess on a bottom surface of the pad, a first thick region surrounding the first thinned region, a second thinned region surrounding the first thick region, and a second thick region surrounding the second thinned region. The first thick region is not vertically extendable. The second thinned region defines one or more flexure mechanisms configured to make the first thinned region and the first thick region movable relative to the second thick region in a direction parallel or substantially parallel to the polishing surface.

18 Claims, 9 Drawing Sheets

REDUCING POLISHING PAD DEFORMATION

RELATED APPLICATIONS

This application is a continuation application and claims the benefit of priority under 35 USC §120 of U.S. application Ser. No. 11/683,392 filed on Mar. 7, 2007, which claims the benefit of U.S. Provisional Application No. 60/780,151, filed on Mar. 7, 2006, which are hereby incorporated by reference in their entirety.

BACKGROUND

The present invention relates to chemical mechanical polishing.

An integrated circuit is typically formed on a substrate by the sequential deposition of conductive, semiconductive, or insulative layers on a silicon wafer. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs, and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head. The exposed surface of the substrate is placed against a rotating polishing disk pad or belt pad. The polishing pad can be either a "standard" pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing slurry, including at least one chemically-reactive agent, and abrasive particles if a standard pad is used, is supplied to the surface of the polishing pad.

SUMMARY

The invention provides methods and apparatus for reducing polishing pad deformation.

In one general aspect, the invention features a polishing pad for use in a chemical mechanical polishing system. The polishing pad includes an outer layer that includes a polishing surface, a first region of a first thickness, and a second region of a second thickness. The first thickness is less than the second thickness. The outer layer further includes one or more flexure mechanisms that allow the first region to move only parallel or substantially parallel to the polishing surface.

In another general aspect, the invention features a method for polishing pad fabrication. The method includes forming a window having a thickness. The method includes forming a recess and one or more slots in the window. The recess defines a first thinned region in the window. The slots are of a depth that is less than the thickness of the window. The slots define a second thinned region in the window, the second thinned region being one or more flexure mechanisms. The method includes securing the window to an outer layer of a polishing pad.

In another general aspect, the invention features a method for polishing pad fabrication. The method includes forming a thinned region in an outer layer of a polishing pad, the outer layer including the thinned region and non-thinned region. The method includes forming one or more slots that penetrate the outer layer adjacent to the thinned region so that one or more portions of the outer layer remain to connect the thinned region to the non-thinned region, whereby the thinned region can move laterally relative to the non-thinned region.

In another general aspect, the invention features a chemical mechanical polishing system that includes a platen that includes a recess, a polishing pad supported by the platen, and a carrier head operable to hold a substrate against the polishing surface. The polishing pad includes an outer layer that includes a polishing surface and that includes a first region situated to overlie, at least partially, the recess. The outer layer further includes one or more flexure mechanisms that allow the first region to move parallel to the polishing surface. The first region is constrained so that the first region is operable to move only parallel or substantially parallel to the polishing surface.

The invention can provide one or more of the following advantages. Deformation of the polishing pad, particularly in the area of the thinned region of the polishing pad, can be reduced or eliminated. Uneven polishing can thus be reduced. One implementation can provide all of the above-described advantages.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
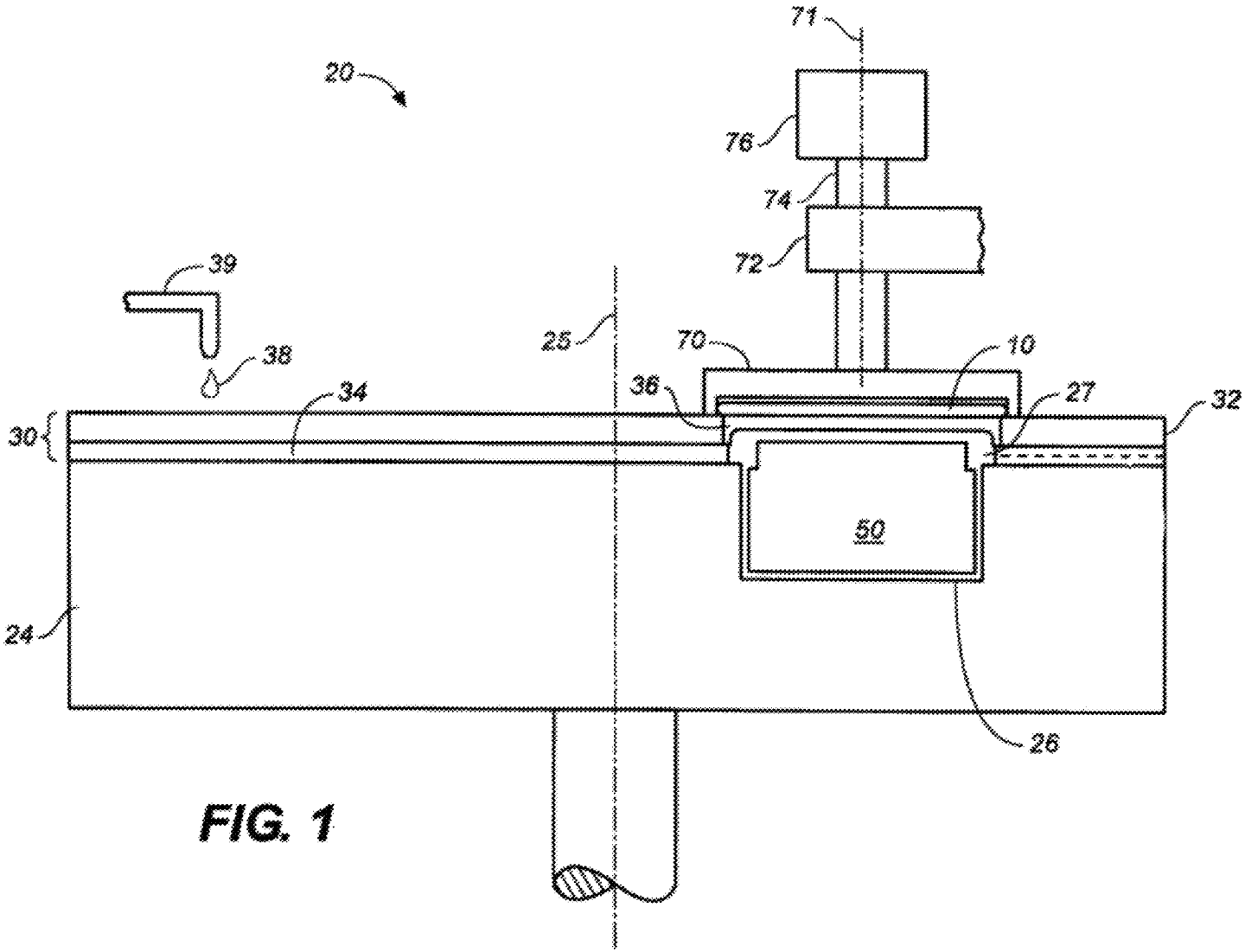
FIG. 1 is a schematic side view, partially cross-sectional, of a chemical mechanical polishing station configured to reduce deformation of the polishing pad.

As shown in FIG. 1, one or more substrates 10 can be polished by a CMP apparatus 20. A description of a suitable polishing apparatus 20 can be found in U.S. Pat. No. 5,738,574, the entire disclosure of which is incorporated herein by reference.

The polishing apparatus 20 includes a rotatable disk-shaped platen 24 on which is placed a polishing pad 30. The polishing pad 30 can be secured to the platen 24, e.g., by a layer of adhesive. The polishing pad 30 can be a two-layer polishing pad with an outer polishing layer 32 and a softer backing layer 34. The polishing station can also include a pad conditioner apparatus to maintain the condition of the polishing pad so that it will effectively polish substrates.

During a polishing step, a slurry 38 containing a liquid and a pH adjuster can be supplied to the surface of polishing pad 30 by a slurry supply port or combined slurry/rinse arm 39. Slurry 38 can also include abrasive particles.

A carrier head 70 can hold the substrate 10 against the polishing pad 30. The carrier head 70 is suspended from a support structure 72, for example, a carousel, and is connected by a carrier drive shaft 74 to a carrier head rotation motor 76 so that the carrier head can rotate about an axis 71. In addition, the carrier head 70 can oscillate laterally in a radial slot formed the support structure 72. In operation, the platen is rotated about its central axis 25, and the carrier head is rotated about its central axis 71 and translated laterally across the top surface of the polishing pad. A description of a suitable carrier head 70 can be found in U.S. patent application Ser. No. 09/470,820, 09/535,575 and 10/810,784, filed Dec. 23, 1999, Mar. 27, 2000, and Mar. 26, 2004, the entire disclosures of which are incorporated by reference.

A recess 26 is formed in platen 24, and an in-situ monitoring module 50 of an in situ monitoring system fits into the recess 26. The in-situ monitoring system can be an eddy current monitoring system, an optical monitoring system or another type of monitoring system or a combination of multiple monitoring systems. The in-situ monitoring module 50 can include one or more sensor elements, which provide better resolution when they are situated close to the substrate being polished. Examples of a sensor element include but are not limited to a U-shaped ferromagnetic core, an E-shaped ferromagnetic core, and a light source and detector. A suitable in-situ module is further described in commonly owned U.S. patent application Ser. Nos. 10/124,507, filed on Apr. 16, 2002, 10/123,917, also filed on Apr. 16, 2002, and 10/633,276, filed Jul. 31, 2003, which are hereby incorporated by reference in their entireties.

In some embodiments, the outer polishing layer 32 is formed from a polishing material and the backing layer 34 is formed from a film. The polishing layer 32 can be formed from a resin, such as a phenolic resins, polyurethane, urea-formaldehyde resin, melamine formaldehyde resin, acrylated urethane, acrylated epoxy, ethylenically unsaturated compound, aminoplast derivative having at least one pendant acrylate group, isocyanurate derivative having at least one pendant acrylate group, vinyl ether, epoxy resin, and combinations thereof. The polishing layer can also include fillers, such as hollow microspheres or voids. The backing layer 34 can be composed of a material such as a polymeric film, e.g., polyethylene terephthalate (PET), paper, cloth, a metallic film, or the like. In some embodiments, the two layers are bonded together, such as with an epoxy or an adhesive, e.g., a pressure sensitive adhesive, or by welding the two layers together. The polishing layer 32 can be between 10 and 150 millimeters, such as between 20 and 80 millimeters.

The polishing pad can include a region 36 that is thinner than other portions of the polishing pad. In particular, the region 36 can be a portion of the polishing pad which is thinner than the outer polishing layer 32, e.g., less than 50% of the thickness of the outer polishing layer 32. The region 36 can be an integral portion of the polishing pad, or it can be an element or part of an element secured, e.g., molded or adhesively attached, to the polishing pad.

The region can be defined, for example, by a recess that is formed in the bottom surface of the polishing pad or that is formed in the element secured to the polishing pad. This recess extends partially but not entirely through the polishing layer so material of the outer polishing layer 32 or element remains. In some implementations, the recess is formed by machining the recess into the bottom surface of the polishing pad or the element. In other implementations, the recess is formed during the molding of the polishing pad or element.

The region 36 is situated over at least a portion of the recess 26 and the module 50. The module 50 and region 36 are positioned such that they pass beneath substrate 10 during a portion of the platen's rotation. The region 36 can be transparent or opaque and, furthermore, can have a top surface that lies flush with the top surface of the polishing pad 30 (i.e., the top surface). The region 36 does not provide an opening for fluid to flow between the recess 26 and the top surface of the polishing pad 30.

Figure 2:
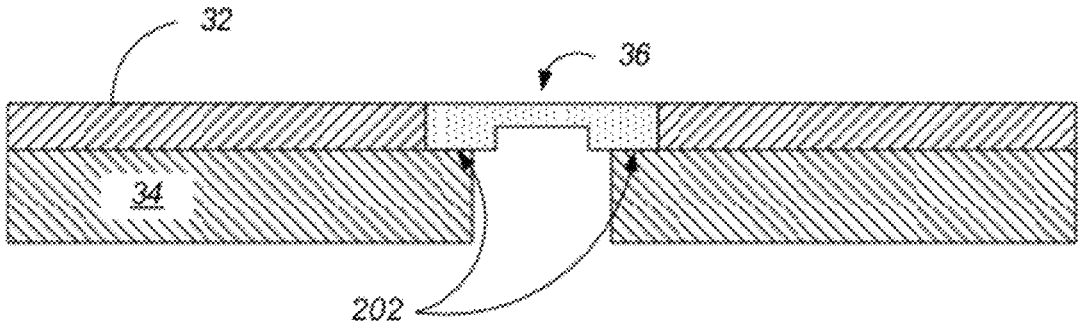
FIG. 2 is a cross section of a polishing pad.

In one implementation, the region 36 is part of a window 37 that includes one or more recesses or indentations configured to accommodate a top portion of the module 50. The recesses allow a sensor of the module 50 to be situated at a distance from the substrate that is less than the thickness of the polishing pad 30. Although, the window 37 can have the same shape as the aperture, the former is not necessarily held in place by friction fit into the latter. In such a case, the window 37 can be secured, for example, by an adhesive, which can be pressure sensitive, that is applied between the interface 202 of the window 37 and the backing layer 34, as shown in FIG. 2.

Alternatively, the window 37 can be a plug for the aperture and can be secured to the outer layer 32 of the polishing pad. In particular, the side walls of the window conform to, abut against, and are sealed with adhesive to the side walls of an aperture in the outer layer 32. In such a case, the adhesive can form a slurry-tight seal between the window and the outer layer 32 so that slurry does not leak past the polishing surface or past the outer polishing layer 32 at the interface of the window 37 and the outer layer 32.

In general, the material of the window should be non-magnetic and non-conductive. The window can be a relatively pure polymer or polyurethane, for example, formed without fillers, or the window can be formed of Teflon or a polycarbonate.

As a suitable alternative to using an adhesive, a molding process can be used to secure the window and pad. For example, the window and outer layer 32 can be secured together by molding the outer layer material around the window. The outer layer material, when cured, chemically bonds with and is, thus, secured to the window. The chemical bonds between the integrated window and the outer layer 32 forms a slurry-tight seal at the periphery of the window. The seal prevents slurry from leaking past the polishing surface or past the outer layer 32. Optionally, the seal can be airtight.

Alternative to being part of a window, the region 36 can be a thinned section that is integral to the outer layer 32. The thinned section, like the recess in the window 37, allows the sensor element of the module 50 to be situated at a distance from the substrate that is less than the thickness of the polishing pad 30. In this alternative implementation, the outer layer 32 is one contiguous piece and, as such, provides a barrier against slurry leakage into the platen 24.

In implementations where there is a slurry tight barrier such that slurry does not leak past the outer polishing layer 32 of the polishing pad 30, for example, the above described integral outer layer implementation and the above described implementation in which the window 37 is secured to the outer polishing layer 32, forces applied during pad conditioning or polishing can cause the region 36 to deform and form a bump in the outer layer 32. Such a bump can rise 20 30 millimeters above the polishing surface of the polishing pad. The above-described phenomenon occurs in pads that have a thinned region and pads that do not have a thinned region.

Without being limited to any particular theory, such a deformation can be avoided or reduced by including a flexure mechanism by which the region 36 can move parallel or substantially parallel to the polishing surface of the outer layer. In implementations in which the outer layer is placed on a horizontal surface, for example, substantially parallel movement includes a lateral movement and/or a side-to-side movement of the region 36 relative to the rest of the outer layer, but not a movement that is purely or mostly vertical. Thus, substantially parallel movement relative to the polishing surface does not include movement that is exactly or mostly perpendicular to the polishing surface but does include lateral movement that is nearly parallel, for example, five to ten degrees variance from being exactly parallel, to the polishing surface. Moreover, the movement of region 36 includes a movement of the entirety of the region 36. In particular, the entire thinned region, rather than only a portion of it, can move as described above.

Figure 3A:
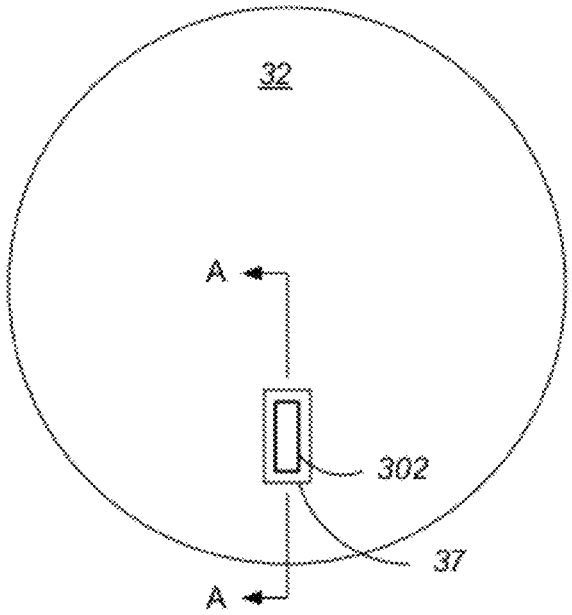
FIGS. 3A-G show examples of flexure mechanisms formed in a window in an outer layer of the polishing pad.
Figure 3B:
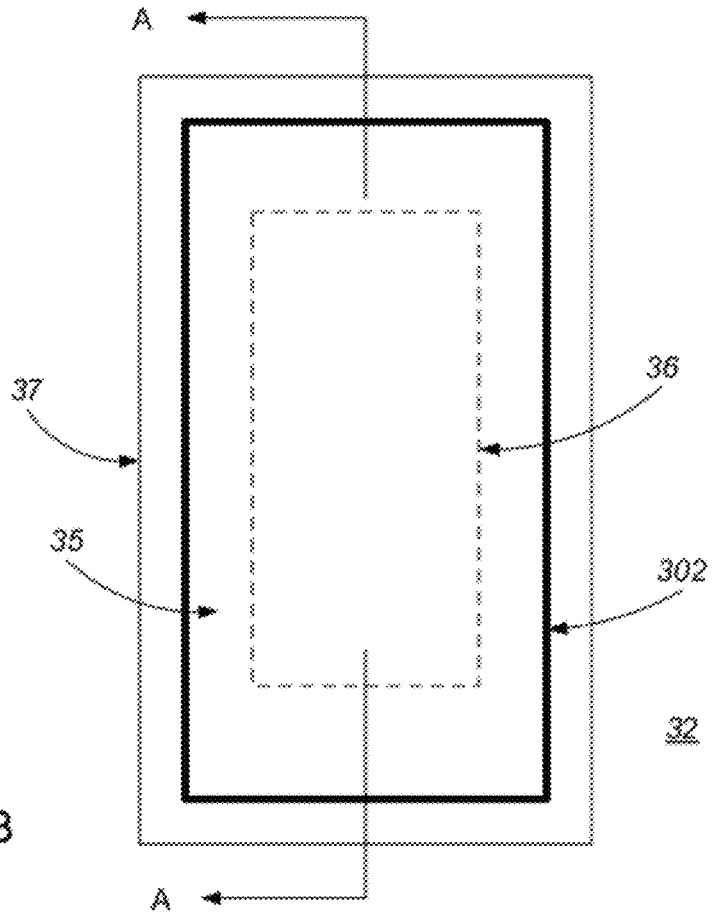
Figure 3C:
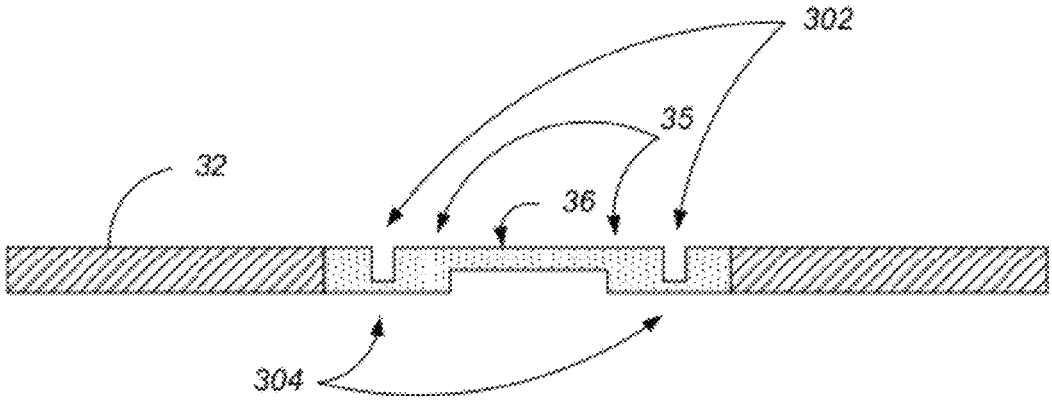

FIGS. 3A, 3B, and 3C show one example of the flexure mechanism. FIG. 3A is a top view of the polish surface of the outer layer 32, which includes the window 37. FIG. 3B is an enlarged view of the polishing layer region that includes the window 37. FIG. 3C shows an enlarged view of cross-section A-A.

In the example depicted, the flexure mechanism is implemented in the window and by forming a slot 302 around the region 36. Between the thinned region 36 and the slot 302 is a thick region 35 which generally has the same thickness as the outer polishing layer 32. The thick region 35 surrounds the thinned region 36 and is not vertically extendable. The flexure 304 surrounds the thick region 35. The region surrounding the flexure mechanism generally has the same thickness as the outer polishing layer 32. In some implementations, the top surfaces of the thinned region 36, the thick region 35, and the region surrounding the flexure mechanism are substantially coplanar.

In general, the slot should be sufficiently deep so that the remaining material of the window 37 that constitutes a flexure 304 allows the thinned region 36 and thick region 35 to move laterally when the pad is subject to conditioning and/or polishing. That is, the flexure 304 is configured to make the thinned region 36 and the thick region 35 movable relative to the outer layer 32 in a direction parallel or substantially parallel to the polishing surface. The remaining material of the window 37 that constitutes the flexure 304 forms a slurry tight barrier to prevent slurry from leaking past the polishing surface of the outer layer. The slot should not be so deep, however, such that the integrity of the flexure 304 is compromised and the flexure 304 may tear within the expected life of the polishing pad. The desired thickness of the flexure can be empirically determined and is a function of, among other things, the material of the window 37, the shear stresses to which the polishing pad is subject during conditioning and polishing, and the usable life expectancy of the polishing pad. In one implementation, a suitable slot has a thickness (i.e., depth) of between about 50 millimeters and 65 millimeters, such as 60 millimeters and a width of between about 55 millimeters and 70 millimeters, such as 62 millimeters for a window made of polyurethane. In some implementations, the slot is formed by machining or molding.

Figure 3D:
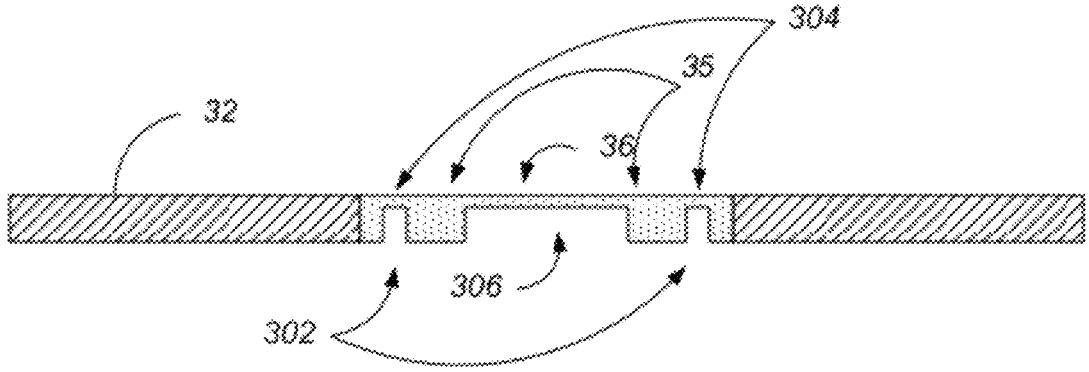

Alternative to being formed only on the top surface of the window 37, i.e., the window surface that is substantially coplanar with the polishing surface of the outer layer 32, the slot 302 can be formed only in the bottom surface of the window 37, as shown in FIG. 3D. The implementation depicted in FIG. 3D facilitates manufacturing. When the slot 302 and the recess 306 that defines the thinned portion 36 is formed by machining, for example, the machining of these features can be effected without having to flip the window 37. When the slot 302 and the recess 306 are formed by molding, for example, the mold features that define the slot and the recess can be implemented on a same side of the mold.

Figure 3E:
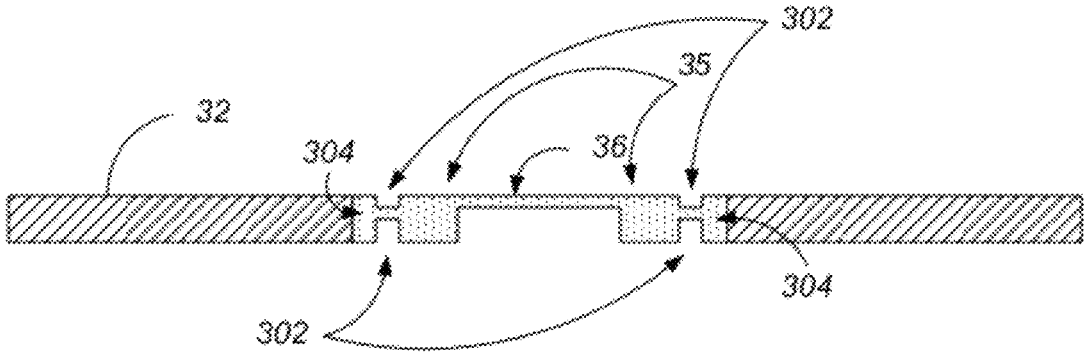

Alternative to the slot being formed on only one side, slots can also be formed on both sides of the window 37, as shown in FIG. 3E. In such a case, there is space for the flexure 304 to flex either up or down. In some implementations, the flexure 304 abuts the outer layer 32. That is, the window material adjacent to the outer layer 32 is thinned due to the slots formed on both sides of the window 37. In some implementations, the flexure mechanism includes multiple slots on the same side of the window 37, where each slot is arranged parallel to and in close proximity to another slot.

For ease of exhibition, FIGS. 3A, 3B, 3C, 3D, and 3E depict only the outer layer 32. A polishing pad, however, may include additional layers, for example, the above-described backing layer 34.

Figure 3F:
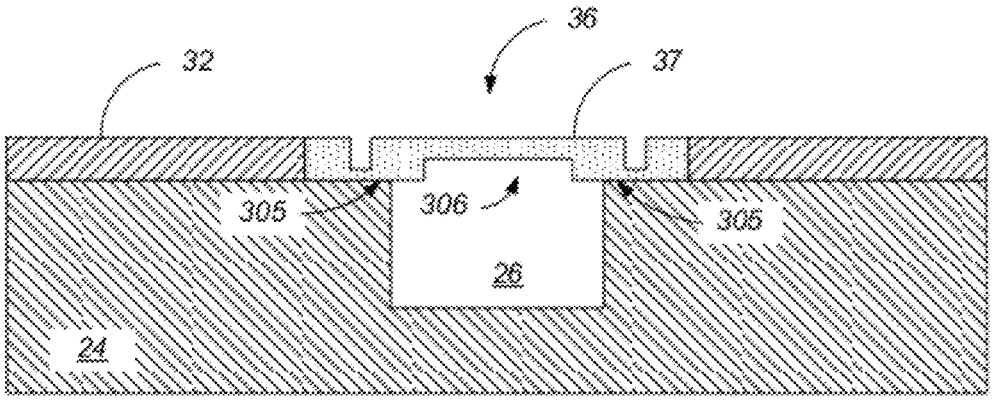
Figure 3G:
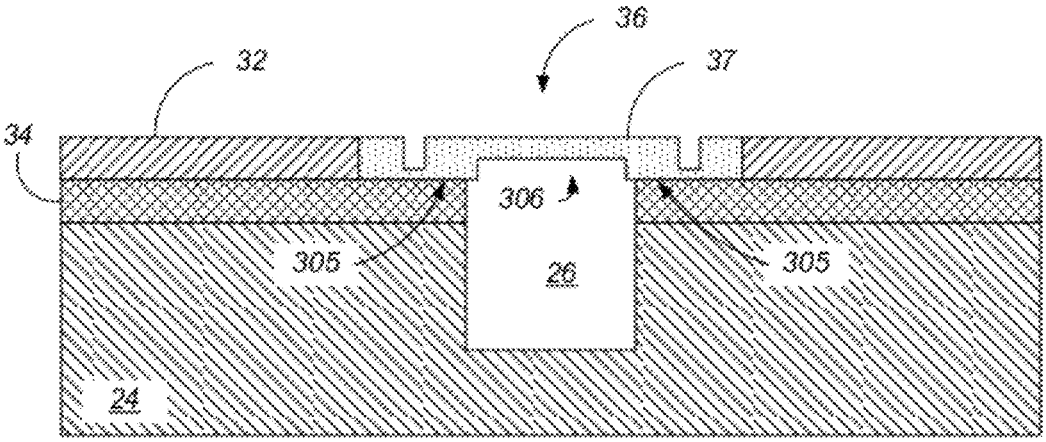

When directly supported by the platen 24, for example, when the polishing pad 30 consists of only an outer layer, or when directly supported by an underlying layer, for example, when the polishing pad includes the outer layer 32 and the backing layer 34, the region 36 and/or the window 37 can be constrained so that it is operable to move only parallel or substantially parallel to the polishing surface of the outer layer 32. In the former case, the platen 24 can so constrain the region 36 and/or the window 37. In the latter case, the backing layer 34 can so constrain the region 36 and/or the window 37. FIGS. 3F and 3G provide examples. In the implementation depicted in FIG. 3F, the recess 26 in the platen 24 can be configured so that the top surface of the platen 24 directly supports at least a portion of the bottom surface 305 of the window 37. Moreover, the region 36 is not constrained in a way that would impede parallel or substantially parallel movement relative to the polishing surface. In the implementation depicted in FIG. 3G, it is the backing layer 34 that provides the direct support rather than the platen 24. In either case, the region 36 is consequently operable to move parallel or substantially parallel relative to the polishing surface while being constrained against moving in a direction perpendicular or substantially perpendicular to the polishing surface, for example, vertically away from the polishing surface.

Figure 4A:
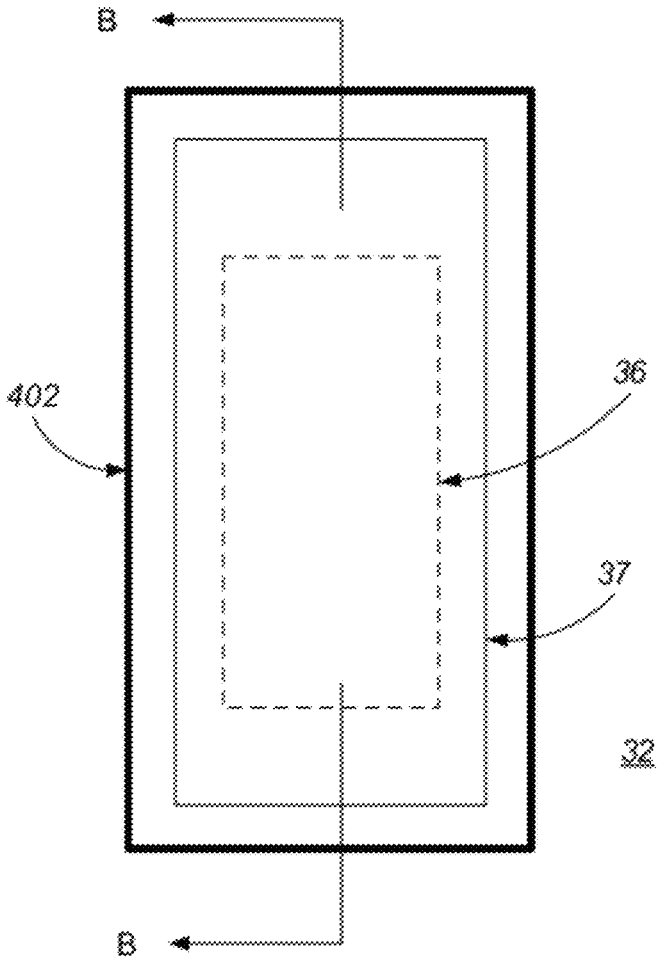
FIGS. 4A-D show examples of flexure mechanisms formed in the outer layer.
Figure 4B:
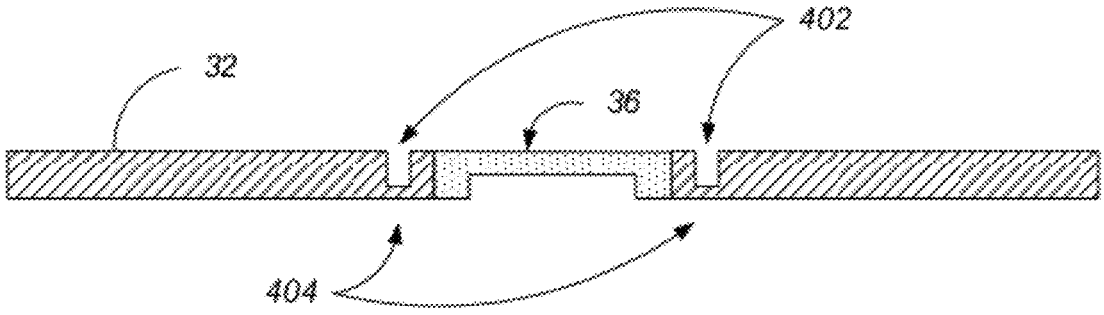
Figure 4C:
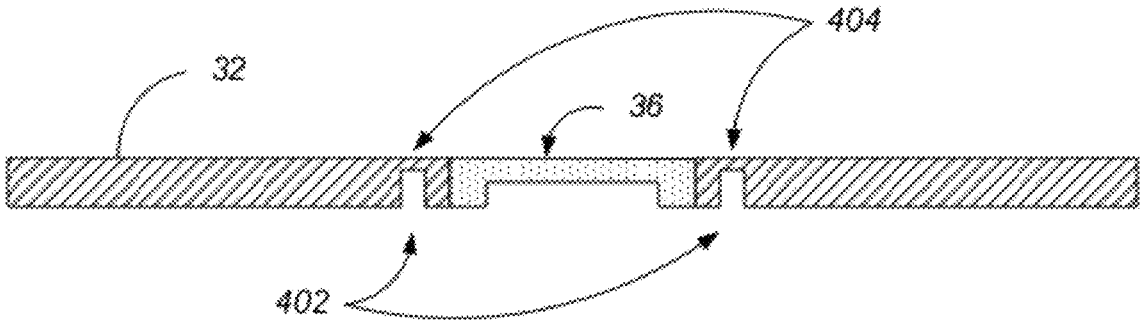
Figure 4D:
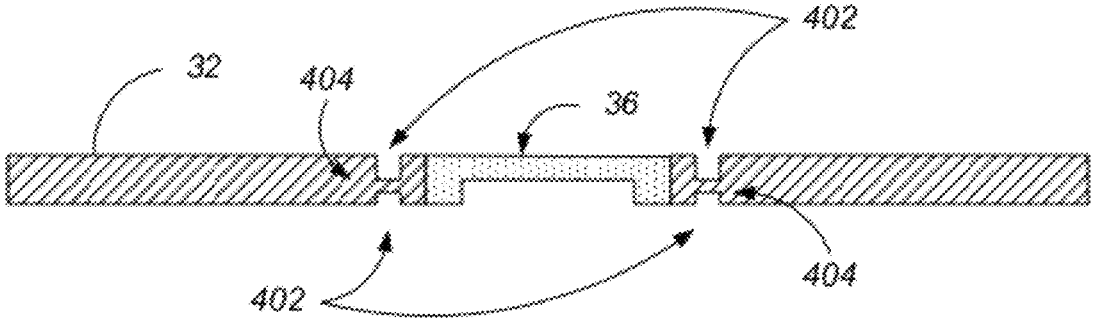

FIGS. 4A, 4B, 4C, and 4D show examples of flexure mechanisms implemented in the outer layer 32 rather than in the window 37, as described above. FIG. 4A is an enlarged view of the polishing layer region that includes the window 37 and a flexure mechanism. FIGS. 4B, 4C, and 4D are enlarged view of the cross section B-B.

As shown in FIGS. 4A and 4B, the flexure mechanism 404 is implemented by forming a slot 402 in the outer layer 32. Between the thinned region 36 and the slot 402 is a thick region that is not vertically extendable. The thick region surrounds the thinned region 36 and the slot 402 surrounds the thick region. A suitable depth of the slot 402 can be empirically determined and depends on factors similar to those discussed above in reference to FIGS. 3A, 3B, and 3C, except that it is the material of the outer layer 32 rather than the material of the window 37 that should be considered. In some implementations, a suitable slot has a thickness (i.e., depth) of between about 50 millimeters and 65 millimeters, such as 60 millimeters and a width of between about 55 millimeters and 70 millimeters, such as 62 millimeters for an outer layer with a thickness of about 80 millimeters.

In some implementations, the slot is formed by machining or molding. In some implementations, the flexure mechanism includes multiple slots on the same side of the outer layer 32, where each slot is arranged parallel to and in close proximity to another slot.

FIG. 4C shows an example in which the flexure mechanism 404 is implemented by forming the slot 402 only on the bottom side of the outer layer. In situations where the outer layer is attached to an underlying layer of the polishing pad, attachment should be effected such that lateral movement of the region 36 would not be impeded. For example, adhesive used to secure the outer layer 32 to an underlying layer should not be applied in the region inside the perimeter defined by the slot 402. FIG. 4D shows an example in which the flexure mechanism 404 is implemented by forming slots 402 on both sides of the outer layer 32. In some implementations, the flexure mechanism 404 abuts the window material. That is, the outer layer 32 adjacent to the window material is thinned due to the slots formed on both sides of the outer layer.

The above-described slots can have a rectangular cross section. Alternatively, the slot can have cross-sections of other geometric shapes, for example, semi circle, square, and triangle. A suitable slot can include rounded corners.

Figure 5A:
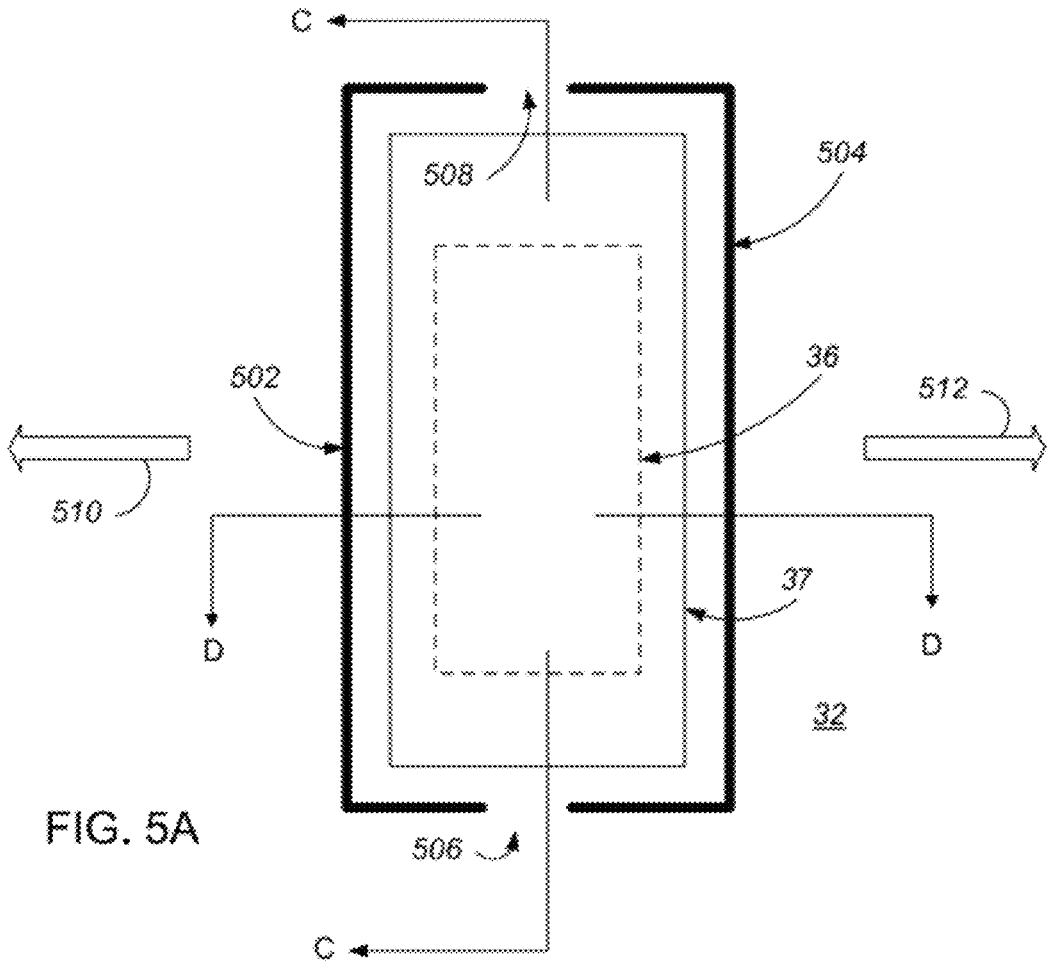
FIGS. 5A-C show examples of flexure mechanisms that do not circumscribe the thinned region of the outer layer.
Figure 5B:
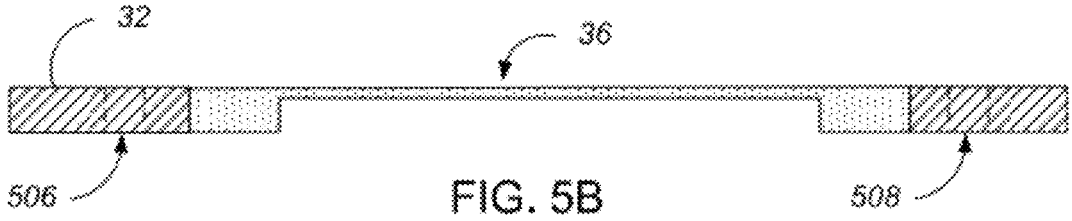
Figure 5C:
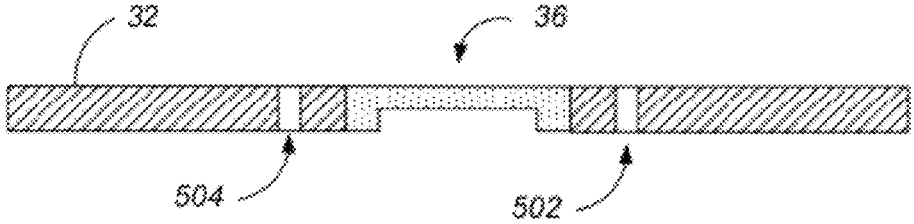

FIGS. 5A, 5B, and 5C show an example in which flexure mechanisms 506 and 508 are implemented by forming slots 502 and 504 that penetrate the entire thickness of the outer layer 32. FIG. 5A is an enlarged view of the polishing layer region that includes the window 37 and the flexure mechanisms 506 and 508. FIG. 5B is an enlarged view of cross section C-C, and FIG. 5C is an enlarged view of cross section D-D. As depicted, flexure mechanisms 506 and 508 allow the region 36 to move laterally, including in the directions indicated by arrows 510 and 512. As with the cases described above, the slots 502 and 504 can be formed by machining or by molding and can have a cross section of any shape.

Figure 6A:
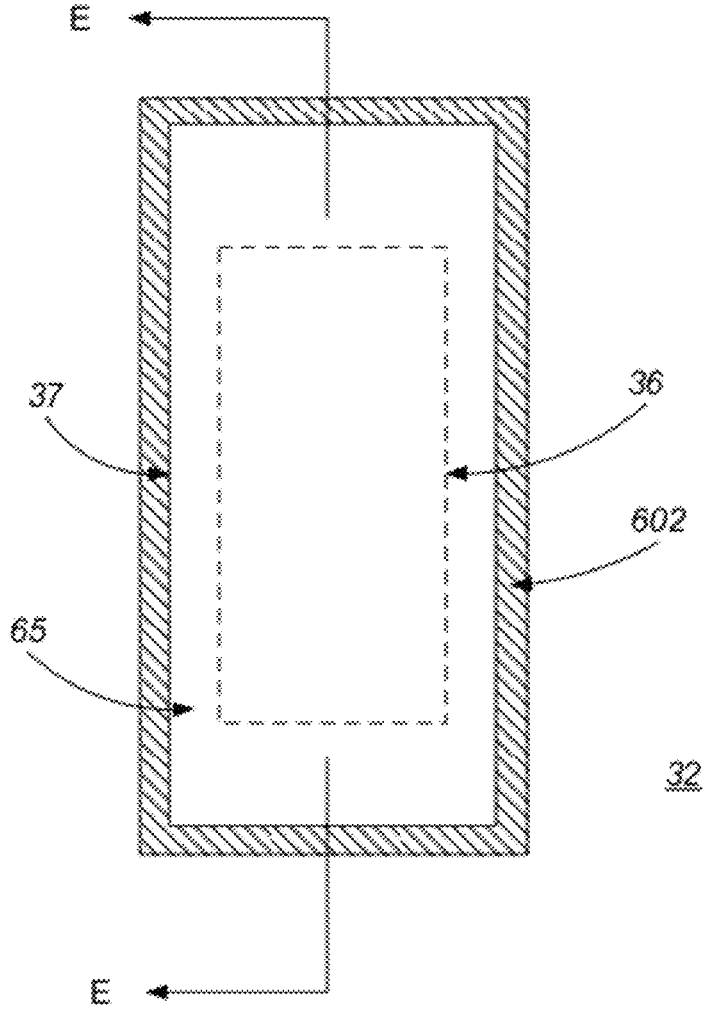
FIGS. 6A-B show examples of compression mechanisms formed between the window and the outer layer.
Figure 6B:
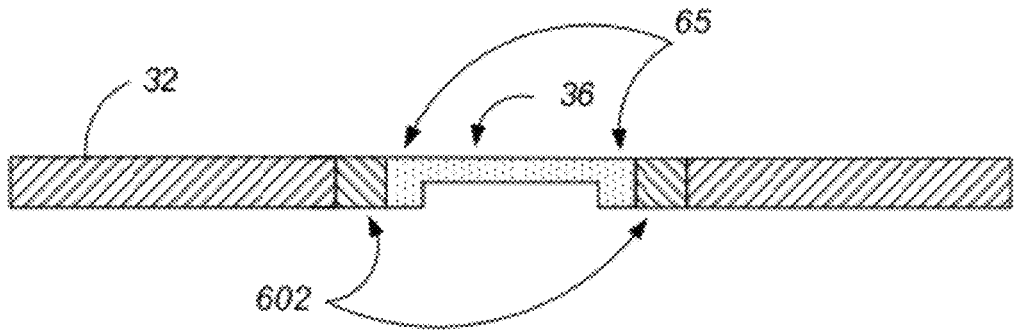

FIGS. 6A and 6B show an example in which a compression mechanism 602 is implemented by using a compressible material between the window 37 and the outer layer 32. FIG. 6A is an enlarged view of the polishing layer region that includes the window 37 and the compression mechanism 602. FIG. 6B is an enlarged view of cross section E-E.

Between the thinned region 36 and the compression mechanism 602 is a thick region 65 which generally has the same thickness as the outer polishing layer 32. The thick region 65 surrounds the thinned region 36 and is not vertically extendable. The compression mechanism 602 surrounds the thick region 65. In some implementations, the top surfaces of the thick region 65, the compression mechanism 602, and the outer layer 32 are substantially coplanar.

The compression mechanism 602 is formed of elastic or flexible material (e.g., silicone, latex, or polyurethane) and should be sufficiently wide to allow the window 37 to move laterally when the pad is subject to conditioning or polishing. That is, the compression mechanism 602 is configured to make the thinned region 36 and the thick region 65 movable relative to the outer layer 32 in a direction parallel or substantially parallel to the polishing surface. In some implementations, the compression mechanism 602 forms a slurry tight barrier to prevent slurry from leaking past the outer layer. Multiple compression mechanisms can be implemented in a polishing pad.

In some embodiments, the compression mechanism 602 is formed by gluing the edges of the window 37 into the edge of the window opening in the outer layer 32. The width of the glue, after curing, must be sufficient to allow the glue material to be compressed. In the case of a molding process, the compressible material can be formed as an outer layer of the window material prior to incorporating the window 37 into the outer polishing layer 32 during the molding process. In some implementations, a material having a low durometer can be used to form the compression mechanism 602. The compression mechanism can be formed of a durable material to withstand pad conditioning. In some implementations, the compression mechanism and the outer layer are made of different materials.

In some implementations, the compression mechanism 602 is arranged as a band entirely within the window 37 or entirely in the outer layer 32, as opposed to being positioned between the window and the outer layer as depicted in FIGS. 6A and 6B. For example, the compressible material may form a stronger bond when molded between two portions of the same material (e.g., the polishing material) than when molded between two different materials (e.g., the polishing material and the window material).

The above described apparatus and methods can be applied in a variety of polishing systems. Either the polishing pad, or the carrier head, or both can move to provide relative motion between the polishing surface and the substrate. The polishing pad can be a circular (or some other shape) pad secured to the platen. Terms of vertical positioning are used, but it should be understood that the polishing surface and substrate can be held in a vertical orientation or some other orientation. The polishing pad can be a standard (for example, polyurethane with or without fillers) rough pad, a soft pad, or a fixed-abrasive pad.

A number of embodiments of the invention have been described. Nevertheless, it will be understood that various modifications may be made without departing from the spirit and scope of the invention. Accordingly, other embodiments are within the scope of the specification.

What is claimed is:

1. A chemical mechanical polishing pad, comprising:

a circular polishing layer that includes a polishing surface; and a solid window secured in the polishing layer, the solid window including a first thinned region defined by a recess on a bottom surface of the window, a first thick region surrounding the first thinned region, the first thick region not vertically extendable, a second thinned region surrounding the first thick region, wherein the second thin region comprises two parallel slots formed in a top surface of the window, the two parallel slots on opposite sides of the recess, the two slots extending primarily radially relative to a center of the circular polishing layer but in parallel, and a second thick region surrounding the second thinned region and abutting the polishing layer, the second thinned region defining one or more flexure mechanisms configured to make the first thinned region and the first thick region movable relative to the second thick region in a direction parallel or substantially parallel to the polishing surface.

2. The polishing pad of claim 1, wherein the one or more flexure mechanisms form a slurry tight barrier so that slurry does not leak past the polishing layer.

3. The polishing pad of claim 1, wherein the two parallel slots have a depth of between about 50 millimeters and 65 millimeters.

4. The polishing pad of claim 1, further comprising:

a backing layer situated beneath the polishing layer such that the backing layer constrains the first thick region from being urged away from the polishing surface.

5. The polishing pad of claim 1, wherein a top surface of the first thinned region, a top surface of the first thick region, and a top surface of the second thick region are substantially coplanar.

6. A method for polishing pad fabrication, the method comprising:

forming a thinned region in a solid window in a polishing layer of a circular polishing pad, the thinned region defined by a recess on a bottom surface of the window, the window including the thinned region and a non-thinned region; and forming two parallel slots in a top surface of the window, the two parallel slots on opposite sides of the recess, the two slots extending primarily radially relative to a center of the polishing pad but in parallel, wherein the slots penetrate the window adjacent to the thinned region so that one or more portions of the window remain to connect the thinned region to the non-thinned region, whereby the thinned region can move laterally relative to the non-thinned region.

7. The method of claim 6, wherein the thinned region is formed by molding or machining.

8. The method of claim 6, wherein the two parallel slots are formed by molding or machining.

9. A chemical mechanical polishing system, comprising:

a platen that includes a first recess, wherein the platen is rotatable;

a polishing pad supported by the platen, the polishing pad including a polishing layer that includes a polishing surface and a solid window secured in the polishing layer, wherein the solid window includes a thinned region situated to overlie, at least partially, the first recess, the thinned region defined by a second recess on a bottom surface of the window, the window further including one or more flexure mechanisms that allow the thinned region to move parallel or substantially parallel to the polishing surface, the thinned region being constrained so that the thinned region is operable to move only parallel or substantially parallel to the polishing surface, wherein the flexure mechanism comprises two parallel slots in a top surface of the window, the two parallel slots on opposite sides of the recess; and a carrier head operable to hold a substrate against the polishing surface, wherein the window is positioned such that rotation of the platen causes the window to move in a path beneath the substrate, and two parallel slots extend perpendicular to the path.

10. The system of claim 9, wherein the one or more flexure mechanisms form a slurry tight barrier so that slurry does not leak past the polishing surface of the polishing layer.

11. The system of claim 9, wherein the polishing pad includes a backing layer underlying the polishing layer, the backing layer being secured to the polishing layer such that the parallel movement of the thinned region is not impeded while non parallel movements of the thinned region are prevented.

12. The polishing pad of claim 1, wherein the first thick region has a uniform width around the perimeter of the first thin region.

13. The polishing pad of claim 1, wherein a portion of the second thin region system extends generally parallel to a radius of the polishing pad passing through the first thinned region.

14. The polishing pad of claim 1, wherein the second thin region has a uniform width around the perimeter of the first thick region.

15. The polishing pad of claim 1, wherein the second thin region comprises at least a first slot formed in the a top surface of the window and at least a second slot formed in the bottom surface of the window and aligned with the first slot.

16. The polishing pad of claim 1, wherein the second thinned region surrounds all sides of the first thick region.

17. The polishing system of claim 9, wherein the window comprises a first thick region surrounding the thinned region, a second thinned region surrounding the first thick region on all sides, and a second thick region surrounding the second thinned region and abutting the polishing layer.

18. The polishing pad of claim 1, wherein the window is more light-transmissive than the polishing layer.

* * * * *

UNITED STATES PATENT AND TRADEMARK OFFICE

CERTIFICATE OF CORRECTION

PATENT NO. : 8,287,330 B1
APPLICATION NO. : 12/625412
DATED : October 16, 2012
INVENTOR(S) : Doyle E. Bennett It is certified that error appears in the above-identified patent and that said Letters Patent is hereby corrected as shown below:

Claim 15, (column 10, line 24), after "the" delete "a".

Signed and Sealed this
Twelfth Day of February, 2013

Teresa Stanek Rea
*Acting Director of the United States Patent and Trademark Office*